United States Patent [19]

Lemmens et al.

[11] 4,276,921

[45] Jul. 7, 1981

[54] PROCESS AND APPARATUS FOR THE CONTINUOUS CASTING OF METAL

[75] Inventors: Alfons E. Lemmens, Herentals; Hendrik A. L. Gielen, Kasterlee, both of Belgium

[73] Assignee: Metallurgie Hoboken-Overpelt, Brussels, Belgium

[21] Appl. No.: 26,808

[22] Filed: Apr. 4, 1979

[30] Foreign Application Priority Data

Apr. 6, 1978 [LU] Luxembourg ..... 79390

[51] Int. Cl.³ ..... B22D 11/06; B22D 11/16

[52] U.S. Cl. ..... 164/4; 164/449; 164/431; 250/577

[58] Field of Search ..... 164/4, 431, 432, 449; 250/357, 577

[56] References Cited

U.S. PATENT DOCUMENTS

| | | | |
|---|---|---|---|
| 2,246,907 | 6/1941 | Webster | 164/449 |
| 2,825,104 | 3/1958 | Jones | 164/449 X |
| 3,036,348 | 5/1962 | Hazlett et al. | 164/449 |
| 3,041,686 | 7/1962 | Hazlett et al. | 164/432 X |
| 3,293,705 | 12/1966 | Lenz et al. | 164/155 |
| 3,459,949 | 8/1969 | Poncet | 164/449 X |
| 3,838,727 | 10/1974 | Levi et al. | 164/449 X |
| 3,842,894 | 10/1974 | Southworth et al. | 164/449 X |
| 3,865,176 | 2/1975 | Dompas et al. | 164/87 |
| 3,921,697 | 11/1975 | Petry | 164/449 X |
| 3,955,615 | 5/1976 | Dompas et al. | 164/432 |
| 4,015,128 | 3/1977 | Vedova | 250/577 X |
| 4,132,259 | 1/1979 | Poncet | 164/4 |
| 4,140,300 | 2/1979 | Gruner et al. | 164/4 X |
| 4,160,168 | 7/1979 | Funck | 164/449 X |

FOREIGN PATENT DOCUMENTS

| | | |
|---|---|---|
| 2296482 | 7/1976 | France . |
| 2313156 | 12/1976 | France . |
| 750690 | 2/1975 | South Africa . |
| 595167 | 1/1978 | Switzerland . |
| 295988 | 12/1971 | U.S.S.R. . |
| 486225 | 9/1975 | U.S.S.R. . |

*Primary Examiner*—Robert D. Baldwin
*Attorney, Agent, or Firm*—Pennie & Edmonds

[57] ABSTRACT

A process and apparatus for the control of a continuous process for casting metal. The apparatus includes a mold cavity (8) formed by upper and lower movable belts (2 and 3, respectively) and side dams (6 and 7) and including an inlet opening (9). Molten metal (11) is flowed to the inlet opening from a source (14) by conduit (12) connecting with an outlet (13). An opto-electronic device (17, 51) provides a signal which is a function of the level of the molten metal at a zone (FIG. 4) within the mold cavity and a circuit (40) responsive to the signal controls the position of a plug (15) relative to the outlet to control the flow of molten metal. The opto-electronic device includes a photosensitive element (23, 57) whose sensitivity lies essentially to radiation within the visible spectrum and only weakly responsive to infra-red radiation.

8 Claims, 14 Drawing Figures

PROCESS AND APPARATUS FOR THE CONTINUOUS CASTING OF METAL

TECHNICAL FIELD

The present invention relates to both a continuous metal casting process wherein the casting is carried out in a mold cavity between movable walls and controlled by an optical system removed from the inlet of the cavity, and apparatus for carrying out the process.

BACKGROUND ART

Processes for the continuous casting of molten metal and the detection of the level of the metal in a mold cavity are known in the prior art.

According to one known process, described in French Pat. No. 2,296,482, molten metal is passed continuously to the inlet of a molding cavity, which may be formed by a pair of moving belts, one belt being located above the other, and a pair of side dams, and the casting process is controlled by the generation of a plurality of signals indicative of the level of the molten metal at the inlet. To this end, in the French patent, several signals are generated by means of heat detectors which are held against the moving belts. The heat detectors are arranged in two series and the apparatus for carrying out the process also includes a device for treatment of the signal from the detectors and a command device.

According to other known processes, referring to U.S. Pat. Nos. 3,459,949 to P. Poncet and 3,838,727 to I. Levi et al, there is also disclosed, in a process for the casting of steel, a system for detection of the level of the molten metal in a mold. Detection is by means of an optical system located outside a molding cavity to expose a photosensitive element in an optical path directed at a field extending on opposite sides of a line of demarcation between the surface of the metal and the wall of the cavity. These patents generally are similar in that they disclose a process for casting steel in a vertical mold with fixed walls and that casting control is achieved by a signal generated by the photosensitive element which is a function of the radiation generated within the field.

A further patent of the prior art, namely U.S. Pat. No. 2,246,907 to W. R. Webster, also discloses an apparatus for the continuous casting of metal. As described in the patents immediately above, the casting process is carried out in a vertical mold, the walls of which are capable of movement, including a quartz rod disposed within and at a predetermined distance below the top of the mold for transmission of radiation to a photosensitive element.

The processes and apparatus of the prior art suffer from various problems and disadvantages. Thus, the process and apparatus of Webster including the photosensitive element which is not exposed to radiation through an optical system located outside of the mold cavity, suffers from the requirement that the quartz rod need be located within the inlet to the mold cavity in the neighborhood of the surface of the molten metal. In this disposition, because of soiling by metal projections, the quartz rod may become unsuitable for transmission of radiation.

As to the casting process and apparatus described by each of Poncet and Levi et al, it is carried out in a mold cavity defined by fixed walls rather than in a mold cavity defined by movable walls. And, the control means of each patent could not be adapted for implementation in a movable wall mold cavity. Considering the apparatus of the French patent, it is relatively complicated both in structure and operation since the treatment device must treat a relatively large number of signals deriving from the plural detectors and the signals are a function of heat rather than light essentially in the visible spectrum.

DISCLOSURE OF INVENTION

It was considered by those skilled in the art, in the casting of metal in a mold cavity defined by moving walls, that a determination and control of the level of the liquid metal bath by optical means could not be carried out with precision to allow an efficient and sufficiently precise casting control. Therefore, in the control of the continuous process of casting metal in molds with movable walls, the prior art has concerned itself with the aforementioned complicated and consequently expensive devices utilizing heat detectors along with the ancillary operative devices. However, it has been found, according to the invention, that the level of a liquid metal bath in a casting process of a continuous type, in a mold cavity defined by moving walls, may be controlled optically both in an efficient and precise manner. Particularly, the continuous casting process wherein the molding cavity may be of a structure as hereinbefore described, is controlled by the generation of a signal through the functioning of a photosensitive element of an optical device. To this end, the optical device is located in the region of, yet removed from, the inlet to the molding cavity and in a disposition such that the optical axis of the optical device is directed toward a zone extending on both sides of a border line between the cast metal and the wall of one side dam not covered by the molten metal. Further, the photosensitive element is one whose sensitivity range essentially is within the visible spectrum and is only weakly responsive to infra-red radiation.

This criteria is of importance in providing the desired measure of control of the level of the liquid metal bath by optical means in the continuous casting process. Thus, directing the optical axis toward the described zone will result in a signal responding with sufficient accuracy and intensity to level variations of the molten metal at the inlet of the mold cavity to command the maintenance of a level of molten metal between admissible upper and lower limits. If, on the other hand, the optical system is not directed at that zone, the intensity variations of the signal are too weak to provide casting control wherein that control is a function of the signal. And, if the sensitivity of the photosensitive element does not lie essentially within the visible spectrum and is other than only weakly responsive to infra-red radiation, the output of the opto-electronic device, to be described, will be below that required for proper control.

The molten metal to be cast is fed to the inlet of the mold cavity by a system of two or more conduits or troughs. Because of movement of the molten metal toward the inlet, accurate and precise control requires the detection of a relatively low level variation of the liquid metal in the mold cavity. This measure of control of the level of the molten metal is with accuracy and reliability obtained by some kind of molten metal wave surging against the upper belt at the inlet of the mold.

This surging gives rise to more important variations of the covering of the side dams by the molten metal than would be the case if only the rising and the lowering of the level of the molten metal were to be taken into account. This effect, together with the fact that the difference between the visible radiation emitted on the one hand by the molten metal, and on the other hand by the relatively cold side dam, is important. To this end, and in this manner, it is possible to obtain precise and accurate control of the casting wherein the signal output of the photosensitive element is a function of response to the radiation of a field located at the zone and border line between the molten metal and the part of a side dam which is not covered by the molten metal.

The apparatus for carrying out the process of continuous metal casting includes a mold formed generally by a pair of endless, moving belts, the lower run of one and the upper run of the other, providing an upper and lower supporting surface, respectively, for the molten metal as it moves downstream from the inlet opening of the mold cavity. A pair of side dams extend along and between the supporting surfaces and together with the belts define a mold cavity. The apparatus also includes means for cooling each side dam and a feeding device for feeding molten metal to the inlet opening. Additionally, the apparatus includes an element capable of producing a signal as a function of the level of the molten metal at the inlet opening, which signal is utilized to control the apparatus.

According to the invention, the element is a photosensitive element comprising a part of an optical system located outside the cavity, and having its optical axis directed at a zone of one of the side dams extending on both sides of the border line between the cast metal and that part of said side dam which is not covered by the metal. The optical system serves to transmit radiation to the photosensitive element whose sensitivity range is essentially within the visible spectrum and only weakly responsive to infra-red radiation. That signal utilized in the control of the apparatus will be a function of the transmitted radiation.

Additional features of the process and apparatus of the invention will appear from the description to follow to be considered with reference to the accompanying drawing.

BEST MODE FOR CARRYING OUT THE INVENTION

Figure 1:
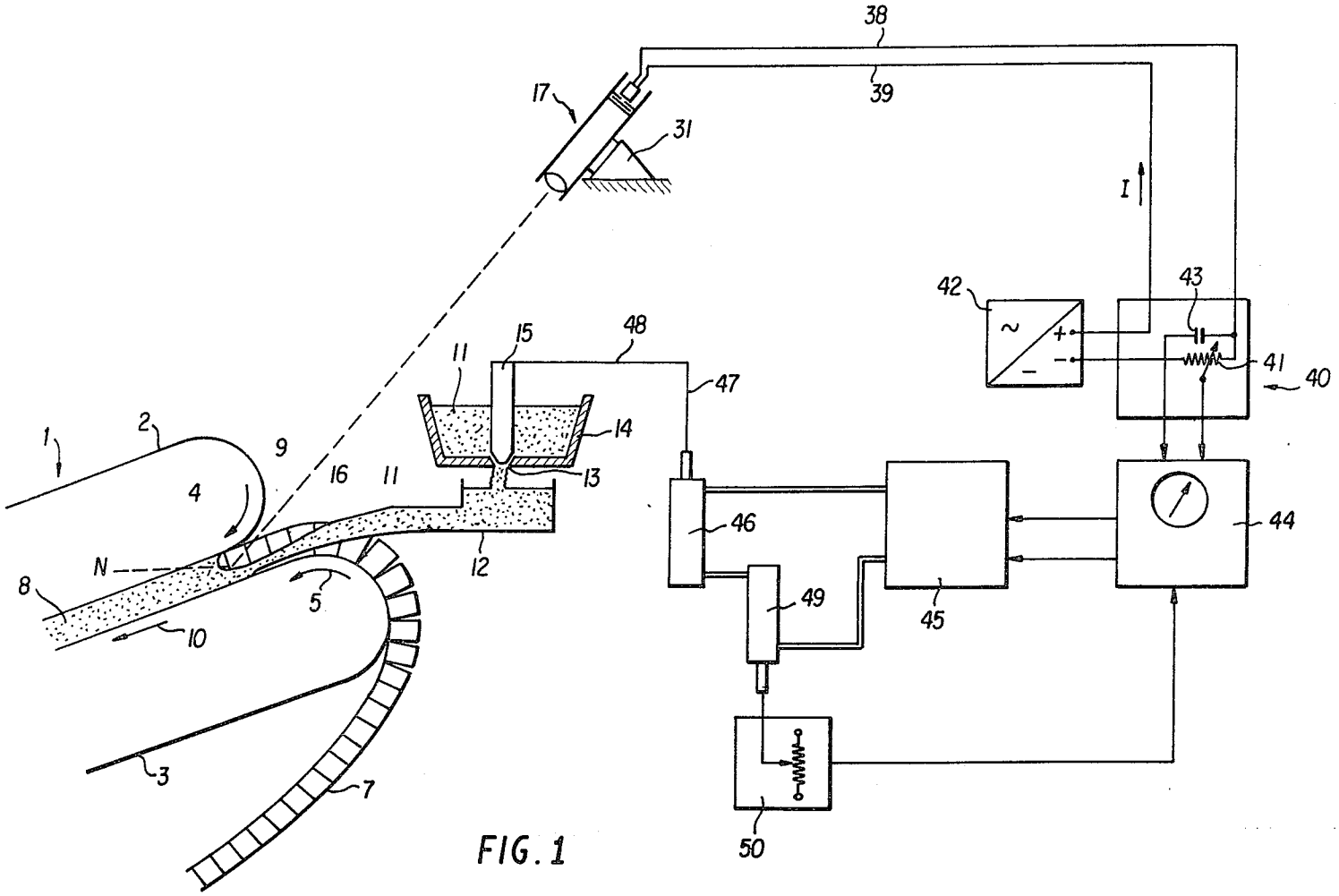
FIG. 1 is a general view of the apparatus of the present invention, illustrating schematically a part of a running casting machine, the feeding device, an opto-electronic device for detecting the level of the liquid metal in said machine, and a level regulating device associated to said detecting device.
Figure 3:
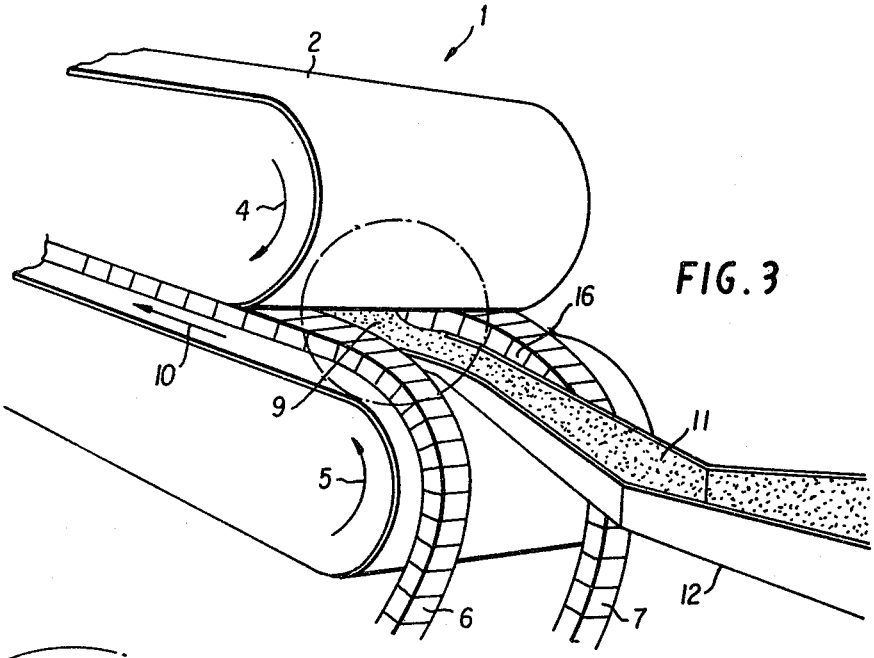
FIG. 3 is a perspective view of the upstream end of the casting machine of FIG. 1, viewed obliquely from a position above the level of the inlet opening of the machine.

The apparatus of the present invention comprises a casting machine ("the machine") 1, perhaps seen to best advantage in FIGS. 1 and 3. The machine includes a mold cavity formed by a pair of endless belts and a pair of endless side dams. Both the belts and side dams are driven continuously during the process by any convenient drive apparatus (not shown). Thus, a belt 2 comprising an upper belt and a belt 3 comprising a lower belt may be entrained about a pair of spaced rollers, one roller of each pair being driven by a prime mover so that the belt 2 moves clockwise and the belt 3 moves counterclockwise in the direction of arrows 4 and 5, respectively.

The side dams 6 and 7 are disposed partly between the lower run of belt 2 and the upper run of belt 3. Each side dam 6 and 7 is formed by a large number of blocks, each of which is conveniently carried by a strap (not shown). The blocks may be formed of metallic materials.

As indicated, the mold cavity is formed by the side dams 6 and 7 and the belts 2 and 3 which, additionally, function to drive the side dams. Thus, the side dams move with the upper and lower belts in the direction of arrow 10, and within the area of the mold cavity 8 the side dams are supported by the lower belt 3. After traverse along the mold cavity to a position beyond the outlet opening (not shown), the several increments of side dams return to the area of an inlet opening 9.

As may be seen in FIG. 1, the mold cavity has a downward angle of inclination toward the output opening. The angle of inclination may be about 15°. As also seen, the upper run of lower belt 3 forms a supporting surface for the material of the casting, and the lower run of upper belt 2 forms an upper limiting surface for the material.

The molten metal in and along molding cavity 8 from the inlet opening may be cooled according to conventional prior art techniques. Thus, as described in U.S. Pat. Nos. 3,036,348 and 3,041,686, both to R. W. Hazelett et al, a cooling liquid may be projected on the belts 2 and 3; and, as described in U.S. Pat. Nos. 3,865,176 and 3,955,615, both to J. M. A. Dompas et al, the cooling liquid may be projected on the side dams 6 and 7 outside of the mold cavity. With the latter, the moving side dams are cooled before they move into contact with the molten metal both at and downstream of the inlet opening.

Without any intent to limit the invention to specific dimensions, but rather to more particularly describe an arrangement of structure defining the mold cavity for production of one endless bar, the belts, i.e., the upper run of belt 3 and the lower run of belt 2 may be spaced at a distance of 6 cm and the side dams may be spaced at a distance of 12 cm.

In the process according to the invention, molten copper 11 at a temperature of about 1120° C. is metered to the inlet opening 9 through tap hole 13 and along a conduit 12 from a supply or source of molten metal 14. The output volume of molten copper is controlled by positioning a stopper 15 relative to the tap hole. As will be described, the stopper position is controlled by system operation as a function of response of the photosensitive element to radiation.

The molten copper flows by gravity to the inlet opening and as it moves through the mold cavity 8, it progressively solidifies thereby to exit the outlet opening in the form of an endless bar. The speed of casting may be about 13 meters per minute and the bar, according to the above specifics, will be 12×6 cm in cross-section.

Figure 2:
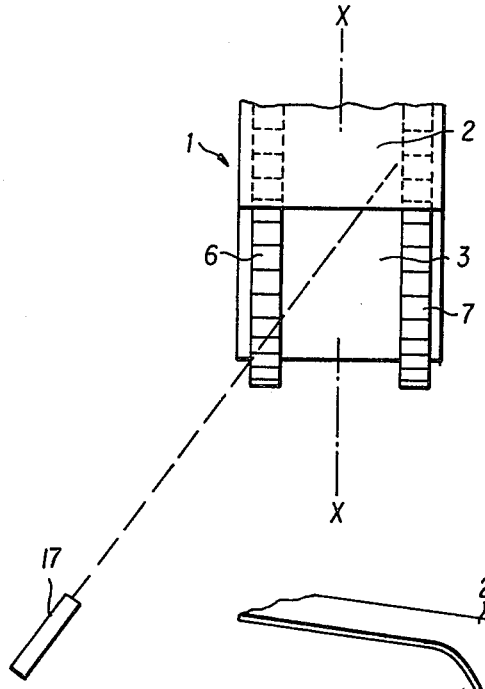
FIG. 2 is a plan view of a part of the apparatus of FIG. 1, illustrating schematically a portion of the casting machine and the opto-electronic device.
Figure 4:
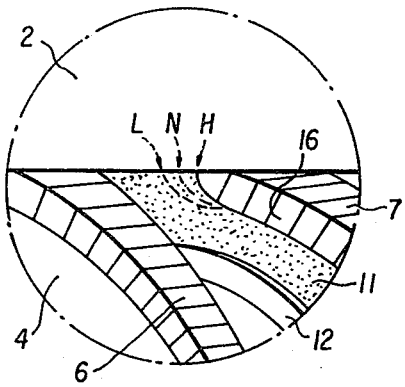
FIG. 4 is an enlarged view of the part of FIG. 3 circled with a dotted line.
Figure 12:
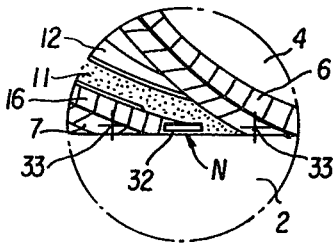
FIG. 12 represents the image formed in the opto-electronic device of FIG. 5 when the metal level is normal.

The zone heretofore described as extending on both sides of the border line between the molten metal 11 and that part of, for example, the face 16 of side dam 7, not covered by the metal is monitored by an opto-electronic device ("the device") 17. The device, again without any intent to limit the invention, but rather to describe one operative embodiment, may be located at a distance of about 4.5 m from the inlet opening 9, at a position about 1.75 m above the level of the inlet and 1 m distant from a medium plane through the mold cavity 8. The median plane is identified by the notation X—X in FIG. 2 and the optical axis, along a path oblique to that axis, is directed to the zone within the inlet opening. As illustrated in FIG. 2, the zone is below the lower run of upper belt 2, yet the oblique axis permits monitoring of the immersion of the face 16 into the molten metal 11. As a consequence of the molten metal wave surging against belt 2, the borderline moves to the right if the level of the metal rises and to the left if the level of metal falls. As illustrated in FIG. 4, the indicia "L", and "N" and "H" represents levels which are too low, normal, and too high, respectively.

Figure 5:
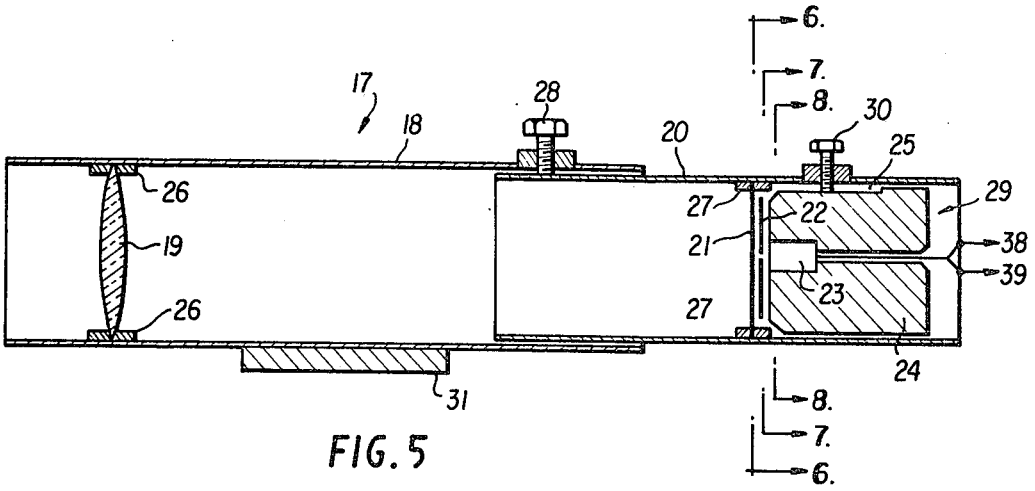
FIG. 5 is an enlarged view in vertical section along the axis of the opto-electronic device of FIG. 1.

Referring to FIG. 5, the device 17 may be seen as including a tube 18 and a biconvex objective 19 supported at 26 near one end of the tube. The focal distance of the objective lens is 650 mm. A tube 20 is received telescopically by tube 18. As illustrated, the tube 20 is received within tube 18. A set screw 28 or the equivalent may be provided for locking the tubes in any of a number of longitudinal positions of adjustment.

A mat glass 21, a diaphragm 22, and a photosensitive element, as previously described, are supported within tube 20. To this end, the mat glass is supported at 27 and a holder 24 supports the photosensitive element. The diaphragm is supported therebetween and preferably by the holder by any convenient means. The diaphragm, holder and photosensitive element form a set 29 which may be adjusted relative to the mat glass. Adjustment may be carried out by providing a guiding groove 25 in the holder which may be locked in position along the tube 20 by a set screw 30 or the equivalent received within the groove. The groove prevents rotation of the set 29 relative to the mat glass 21.

Figure 6:
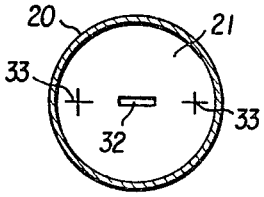
FIG. 6 is a view in section as seen along the line 6—6 in FIG. 5.
Figure 7:
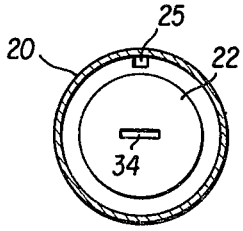
FIG. 7 is a view is section as seen along the line 7—7 in FIG. 5.
Figure 8:
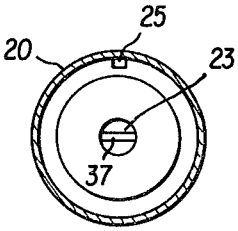
FIG. 8 is a view in section as seen along the line 8—8 in FIG. 5.

A rectangle 32 (see FIG. 6) and two marks 33 are drawn on the mat glass 21. The rectangle has a dimension of 5×1 mm. A rectangular aperture 34 likewise having a dimension of 5×1 mm is formed in diaphragm 22. When the set 29 is fixed inside tube 20 against mat glass 21, the aperture 34 will coincide with the rectangle on mat glass 21.

Figure 9:
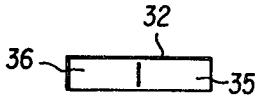
FIGS. 9, 10 and 11 illustrate on an enlarged scale a detail of the image formed in the opto-electronic device of FIG. 5, when said device optically is directed to the zone of FIG. 4 to respond to different levels of the cast metal.

The device 17 is mounted on a support 31 for movement thereby to monitor the zone circled by the dashed line in FIG. 3. In so monitoring the zone, the right half of rectangle 32 will be illuminated by the molten copper 11 when its level within the input opening is normal (N). As seen in FIG. 9, the illuminated part of the rectangle is identified by the numeral "35", while the dark part, corresponding to a part of the face 16 is identified by the numeral "36". If the level of the molten copper should fall below the normal level (L) or rise above the normal level (H), then the illuminated portion of the rectangle will decrease in area (FIG. 10) and increase in area (FIG. 11), respectively.

To locate the device 17, the set 29 is first removed and the tube 18 is directed toward the zone. The mat glass 21 is viewed from the rear and the image from the zone is focused in rectangle 32 by sliding tube 20 relative to tube 18. The image appears as the inverse image of that part of the zone being monitored. When the image is sharp, the position of the tubes are locked by set screw 28. To facilitate both the locating and focusing of the image, two marks (not shown) may be provided on a stationary part (also not shown) of the machine. These marks may be used to locate the marks 33 on the mat glass in a position of coincidence to insure correct positioning of the device 17. Once the device is correctly located, the set 29 may be returned to and positioned within tube 20.

The photosensitive element 23 is a cadmium sulfide resistance having a sensitive surface 37. The surface is rectangular in outline and of an area of 5×1 mm. Thus, the area of the sensitive surface coincides with that of the aperture 34 of diaphragm 22 which acts as a screen against the reflection of light on mat glass 21. The sensitivity of the photosensitive element is highest between 500 and 650 nanometers, i.e., in the visible spectrum.

Connectors 38 and 39 connect the photosensitive element to a converter 40 including a stabilized current source 42. Connection is by a series connection through a resistor 41.

The level of illumination, depending upon the level of the molten metal within the zone to which the photosensitive element responds, will result in resistance variations and consequently variations in current flow within the converter. Capacitor 43 connected across resistor 41 prevents rapid changes in current level thereby to prevent rapid variations and smooth the input to a regulator 44. The regulator may be of the PID type and according to this regulation, through structure to be described, the level of molten metal, if it is to be varied, will vary gradually.

One or more valves of an hydraulic system 45 are controlled by regulator 44. The hydraulic system includes a cylinder 46 and a piston movable therein. A pair of rods 47 or 48, schematically shown connect the piston to stopper 15. Cylinder 49 is a follow-up cylinder connected in series with cylinder 46 and, likewise, controlled by converter 45. A piston is movable in cylinder 49 and connected to the movable tap of a potentiometer 50. An electrical signal indicative of the position of the piston of cylinder 49 and consequently the piston of cylinder 46 then is fed back to regulator 44 which, in turn, varies the input to the hydraulic system.

Figure 10:
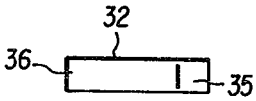
Figure 11:
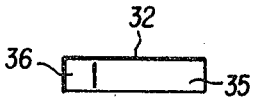

The device 17 has a yield of 70%. By this it is meant that a current of 100 units may be measured when the level of the copper is raised so that rectangle 32 is substantially illuminated (FIG. 11), a current of 30 units may be measured when the level of the copper is lowered so that rectangle 32 is substantially dark (FIG. 10).

The photosensitive element 23 formed of cadmium sulfide provides results significantly better then results achieved through use of a photosensitive element formed of silicon, having a sensitivity in the range of about 700 to about 1000 nanometers, which essentially is within the infrared spectrum. Based upon the above definition, the yield of the device is about 20%. This is the yield notwithstanding the fact that the liquid copper has a temperature of about 1120° C. and the face 16 is at a temperature of about 130° C. Such a yield detracts from the ability of the regulating circuit to regulate the level of the molten metal, since the influence of perturbing signals then is too great.

Figure 13:
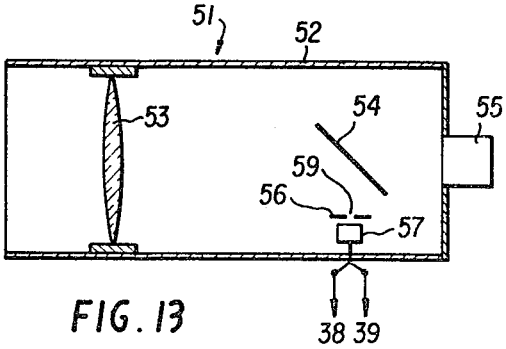
FIG. 13 is a view similar to FIG. 5 of an alternative form of the opto-electronic device utilized in the apparatus; and, FIG. 14 is a front view on an enlarged scale of a part of the device of FIG. 13.
Figure 14:
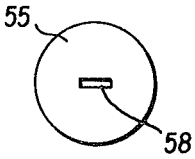

In a second form, see FIGS. 13 and 14, the opto-electrical device 51 comprises a cylindrical chamber 52 having a biconvex objective 53, a semi-transparent mirror 54 in an inclined position relative to the axis through the chamber, an ocular 55, a diaphragm 56 and a photosensitive element 57 formed by a cadmium sulfide resistance. The biconvex objective is supported at one end of the chamber in the manner previously described. Also, as previously described, a rectangle 58 (see FIG. 14) is drawn on the ocular and a rectangular aperture 59 of like size is formed in the diaphragm. Diaphragm 56 is disposed by any conventional structure in such a way that its aperture 59 receives the radiation emitted by the field within the zone through objective 53, mirror 54 and rectangle 58 of ocular 55.

Device 51 may be fabricated from a conventional optical pyrometer. To this end, the shape of the outline on the ocular and that of the aperture in the diaphragm may be changed from that of round in a conventional optical pyrometer, and the photosensitive element having a sensitivity essentially within the visible spectrum may be substituted for the photosensitive element in a conventional optical pyrometer which is especially sensitive to infra-red radiation.

It must be understood that the invention is not limited to the above-described mode of realization and that many modifications without departing from the scope of the present invention are contemplated.

Thus, for example, the cadmium sulfide resistance 23 (and 57) may be replaced by any photosensitive element (photoconducting element, photovoltaic element, photodiodes, and so forth), which either together with or without a filter for absorbing infra-red radiation, react substantially only to the visible light.

As a further alternative, referring to the control of the feeding of molten metal to the inlet opening of the casting machine, it is also possible to utilize the signal controlled by the photosensitive element, as described above, to control the casting speed, i.e., the speed of movement of the belts and side dams of the casting machine.

As a further alternative, side dams 6 and 7 acting through movement as a heat sink may be maintained in a fixed disposition and provided with means for the circulation of a cooling agent through a closed path.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

We claim:

1. A process for controlling the casting of metal comprising:

(a) flowing molten metal to an inlet opening of a mold cavity, said mold cavity being formed partially by moving belts including an upper and lower belt and enclosed by a pair of side dams serving as a heat sink to solidify said metal as it traverses said mold cavity to an outlet opening, (b) exposing a photosensitive element whose range of sensitivity essentially is between 500 and 650 nanometers and only weakly responsive to infra-red radiation by an optical device removed from said cavity to radiation emanating from a zone within said cavity, said zone extending on both sides of a line of demarcation between said molten metal and a surface on one of said side dams not covered by said metal, (c) generating a signal which varies as a function of the area of said surface not covered by said molten metal whereby said signal is indicative of the level of said molten metal within said zone, and (d) using said generated signal to control one of the volume of molten metal flowing to said inlet opening and the speed of movement of said moving belts and side dams.

2. The process of claim 1 wherein said metal in the molten state at said cavity is at a temperature of less than about 1200° C.

3. The process of claim 2 wherein said molten metal is copper.

4. The process of claims 1, 2 or 3 wherein said casting of metal is carried out in a continuous manner.

5. Apparatus for controlling the casting of metal comprising:

(a) a mold including an inlet and outlet opening and formed by (1) upper and lower belts spaced apart and adapted to be driven in movement to follow a path from said inlet to said outlet opening, and (2) a pair of side dams enclosing said cavity, said belts and dams serving as limiting surfaces for the cast metal, (b) means for cooling said side dams to provide cooling for said molten metal which partially solidifies in traverse through said mold cavity, (c) means for passing molten metal to said inlet opening, (d) means for generating a signal including (1) a photosensitive element whose range of sensitivity essentially is between 500 and 650 nanometers and only weakly responsive to infra-red radiation, and (2) an optical device located outside of said cavity, said optical device having an optical axis directed toward to monitor a zone within said mold cavity extending on both sides of a line of demarcation between said molten metal and a surface on one of said side dams not covered by said metal to expose said photosensitive element, and said signal varying as a function of the area of said surface not covered by said molten metal whereby said signal is indicative of the level of said molten metal within said zone, and (e) means responsive to said signal to control the volume of molten metal passed to said inlet opening.

6. Apparatus according to claim 5 wherein said optical device includes:

(a) an objective lens, (b) a mat glass element, said objective lens functioning to focus an optical image of said zone on said mat glass element, (c) a diaphragm located between said elements, and (d) means carried by said optical device for supporting each said lens, elements and diagraphm.

7. The apparatus of claim 6 wherein a pair of marks are located both on said mat glass element and a stationary part associated with said mold cavity for purposes of locating said optical axis to said zone.

8. Apparatus according to claim 5 wherein said optical device includes:

(a) an objective lens, (b) a positioning ocular, (c) an inclined semi-transparent mirror, said mirror located on an optical path between said objective and said ocular and providing a surface upon which radiation from said zone converges, (d) a diaphragm between said mirror and said photosensitive element, and (e) means carried by said optical device for supporting said objective lens, ocular element, diaphragm and photosensitive element.

* * * * *

UNITED STATES PATENT AND TRADEMARK OFFICE

CERTIFICATE OF CORRECTION

PATENT NO. : 4,276,921

DATED : July 7, 1981

INVENTOR(S) : Alfons E. Lemmens et al.

It is certified that error appears in the above—identified patent and that said Letters Patent is hereby corrected as shown below:

Column 8, line 35, "mold including" should read

-- mold cavity including --.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*